US010821039B2

(12) United States Patent
He et al.

(10) Patent No.: US 10,821,039 B2
(45) Date of Patent: Nov. 3, 2020

(54) CARE BED

(71) Applicant: JIANGSU HENGAI MEDICAL EQUIPMENT CO., LTD, Yancheng (CN)

(72) Inventors: Hang He, Shanghai (CN); Hanzhong He, Yancheng (CN)

(73) Assignee: JIANGSU HENGAI MEDICAL EQUIPMENT CO., LTD, Yancheng (CN)

( * ) Notice: Subject to any disclaimer, the term of this patent is extended or adjusted under 35 U.S.C. 154(b) by 0 days.

(21) Appl. No.: 16/632,405

(22) PCT Filed: Jul. 23, 2018

(86) PCT No.: PCT/CN2018/096707
§ 371 (c)(1),
(2) Date: Jan. 20, 2020

(87) PCT Pub. No.: WO2019/019978
PCT Pub. Date: Jan. 31, 2019

(65) Prior Publication Data

US 2020/0229997 A1 Jul. 23, 2020

(30) Foreign Application Priority Data

Jul. 22, 2017 (CN) ..... 2017 1 0603324
Jul. 22, 2017 (CN) ..... 2017 1 0603325
Jul. 22, 2017 (CN) ..... 2017 1 0603330

(51) Int. Cl.
*A61G 5/00* (2006.01)
*A61G 5/10* (2006.01)
*A61G 7/015* (2006.01)

(52) U.S. Cl.
CPC ..... *A61G 5/006* (2013.01); *A61G 5/104* (2013.01); *A61G 7/015* (2013.01)

(58) Field of Classification Search
CPC ..... A61G 5/006; A61G 5/104; A61G 5/127; A61G 5/122; A61G 7/015; A61G 7/16; A61G 7/165
See application file for complete search history.

(56) References Cited

U.S. PATENT DOCUMENTS 2,607,929 A * 8/1952 Balluff ..... A61G 5/006 5/618
3,881,773 A * 5/1975 Rodaway ..... A61G 5/006 280/250.1

(Continued)

FOREIGN PATENT DOCUMENTS

CN 101342108 A 1/2009
CN 103156743 A 6/2013

(Continued)

*Primary Examiner* — David R Hare
*Assistant Examiner* — Alexis Felix Lopez
(74) *Attorney, Agent, or Firm* — Bayramoglu Law Offices LLC

(57) ABSTRACT

A care bed includes a bed body provided with a groove and a wheelchair disposed in the groove. The wheelchair includes: a wheelchair support sequentially provided with a wheelchair back plate, a seat plate, a leg plate and a foot plate, and the seat plate is fixed to the wheelchair support; a double-traction lifting regulator disposed below a connection position between the wheelchair back plate and the seat plate; a locking member disposed on the double-traction lifting regulator; a first traction member connected to the locking member; and a second traction member connected to the locking member. When the wheelchair is combined with the bed body, the second traction member controls the locking member to be loosened; and when the wheelchair is separated from the bed body, the second traction member controls the locking member to be locked.

10 Claims, 10 Drawing Sheets

(56) References Cited

U.S. PATENT DOCUMENTS

| | | | | | |
|---|---|---|---|---|---|
| 4,655,471 | A * | 4/1987 | Peek | A61G 5/1067 | 280/250.1 |
| 4,987,620 | A * | 1/1991 | Sharon | A61G 5/006 | 5/600 |
| 5,294,141 | A * | 3/1994 | Mentessi | A61G 5/00 | 188/2 F |
| 5,555,582 | A * | 9/1996 | Jerideau | A61G 5/006 | 5/600 |
| 6,224,156 | B1 * | 5/2001 | Fleigle | A61G 5/1067 | 280/304.1 |
| 6,272,702 | B1 * | 8/2001 | Uchida | A61G 5/006 | 5/600 |
| 6,296,265 | B1 * | 10/2001 | Lovins | A61G 5/12 | 280/250.1 |
| 7,144,026 | B2 * | 12/2006 | Kao | A61G 5/1067 | 280/250.1 |
| 9,295,596 | B2 * | 3/2016 | He | A61G 5/006 | |
| 9,649,234 | B2 * | 5/2017 | Kume | A61G 1/00 | |
| 2004/0227331 | A1 * | 11/2004 | Chen | A61G 5/1002 | 280/650 |

FOREIGN PATENT DOCUMENTS

| | | | |
|---|---|---|---|
| CN | 204744701 | U | 11/2015 |
| CN | 205459478 | U | 8/2016 |
| CN | 106806071 | A | 6/2017 |

* cited by examiner

CARE BED

CROSS REFERENCE TO THE RELATED APPLICATIONS

This application is the national phase entry of International Application No. PCT/CN2018/096707, filed on Jul. 23, 2018, which is based upon and claims priority to Chinese Patent Applications No. 201710603324.8, No. 201710603330.3 and No. 201710603325.2, all filed on Jul. 22, 2017, the entire contents of which are incorporated herein by reference.

TECHNICAL FIELD

The present disclosure relates to a care bed.

BACKGROUND

It is very difficult to transfer a disabled patient from a care bed to a wheelchair, and for many bedridden patients or disabled patients, it is very necessary to transfer them from a bed to a wheelchair, which not only makes them easier to live, have good mood, but also is beneficial to their physical recovery. Therefore, a kind of combined product of a wheelchair and a bed is produced, which can realize the transformation of a part of the bed into a wheelchair, and the wheelchair can be compatible with the functions of body turning and bathing on the bed. The control system of the electric push rods are used to realize the separation of the wheelchair and the bed, but the control system procedures are complicated, it takes long time to have the push rod work in turn, the production cost is high, and it is difficult for nurses to grasp the operation procedure.

SUMMARY

In order to solve at least one of the above technical problems, the present disclosure provides a care bed, comprising a bed body provided with a groove; a wheelchair disposed in the groove. The wheelchair comprises: a wheelchair support provided with a wheelchair back plate, a seat plate, a leg plate and a foot plate sequentially, the seat plate being fixed to the wheelchair support; a double-traction lifting regulator disposed below a connection position between the wheelchair back plate and the seat plate; a locking member disposed on the double-traction lifting regulator and used for locking the double-traction lifting regulator; a first traction member connected to the locking member and used for controlling the rise and the fall of the wheelchair back plate when the wheelchair is separated from the bed body; and a second traction member connected to the locking member, when the wheelchair is combined with the bed body, the second traction member controls the locking member to be loosened, so that the wheelchair back plate and the back plate of the bed body rise or fall at the same time; and when the wheelchair is separated from the bed body, the second traction member controls the locking member to be locked, so that the rise and the fall of the wheelchair back plate is controlled by the first traction member.

According to at least one embodiment of the present disclosure, the care bed provided by the present disclosure further includes: a sliding connecting rod connected to the wheelchair back plate and a wheelchair leg lifting and dropping support respectively, and the wheelchair leg lifting and dropping support is used to control the lifting and dropping of the leg plate and the foot plate; and a locking and releasing bolt, which is provided on the sliding connecting rod and is used to lock the sliding connecting rod when the wheelchair is separated from the bed body, so that the wheelchair back plate can be moved with the leg plate and the foot plate jointly.

According to another embodiment of the present disclosure, the care bed further comprises a wheelchair leg lifting and dropping driving mechanism, which is disposed under the seat plate and is connected to the sliding connecting rod, and the wheelchair leg lifting and dropping driving mechanism controls the sliding connecting rod so that the wheelchair can be transformed to a wheelchair, a recliner or a flat bed mutually.

According to another embodiment of the present disclosure, the second traction member comprises: a shift lever, the front end of which is in contact with the locking member, and the rear end of the shift lever is matched with a step provided on the bed body support, when the wheelchair is combined with the bed body, the rear end of the shift lever can rest on the step and the locking member can be released; when the wheelchair is separated from the bed body, the rear end of the shift lever can be dropped from the step, and the locking member is locked.

According to another embodiment of the present disclosure, the rear end of the shift lever is a unidirectional curved tube that can be elastically reset.

According to another embodiment of the present disclosure, the step is a slidable step or a fixed step.

According to another embodiment of the present disclosure, the second traction member further comprises a soft cable, and the soft cable is connected to the slidable step and able to pull the slidable step to slide.

According to another embodiment of the present disclosure, the second traction member comprises a second brake wire; a lever that is connected to the second brake wire, and the fulcrum of the lever is provided at a rear portion of the wheelchair support, and when the wheelchair is combined with the bed body, one end of the lever is subjected to the thrust applied by the bed body support and rotates, so that the second traction member is tensioned, and the second traction member controls the locking member to release.

According to another embodiment of the present disclosure, the second traction member comprises a second brake wire; a slider member that is connected to the second brake wire, the slider member is located in a chute fixed at the rear portion of the wheelchair support, and when the wheelchair is combined with the bed body, the slider member is subjected to the thrust applied by the bed body support and slides, so that the second traction member is tensioned, and the second traction member controls the locking member to release.

According to another embodiment of the present disclosure, the care bed further comprises: a bracket, which is disposed below the front portion of the seat plate, and is hinged to the wheelchair support; a bracket hook, which is disposed at the front portion of the bracket, and extends to the lower side of the foot plate, controls the rotation angle of the foot plate; a linkage stick, which is connected to the rear portion of the bracket; a bolt, which is disposed at the end of the bed; a diagonal block, which is disposed on the outside the rear leg of the wheelchair, and the width of the diagonal block gradually increases along the length direction of the bed body; a horizontal shaft, which is disposed on the bed body support, supported by the bed body support, and the direction of the horizontal shaft is the same as the width direction of the bed body support; an elastic contact fixing buckle, which is parallel to the horizontal shaft; a rigid connecting rod, which is connected to the rear end of the elastic contact fixing buckle and the horizontal shaft respectively; a shift handle and toggle levers, which are disposed on the horizontal shaft; when the wheelchair is combined with the bed body, the elastic contact fixing buckle is engaged with the diagonal block, so that the wheelchair and the bed body can be merged; when the wheelchair is separated from the bed body, the shift handle is rotated, so that the elastic contact fixing buckle is rotated and separated from the diagonal block, at the same time the toggle levers are rotated to push the wheelchair to move toward the end of the bed.

BRIEF DESCRIPTION OF THE DRAWINGS

The drawings illustrate exemplary embodiments of the present disclosure and, together with the description, serve to explain principles of the present disclosure. The accompanying drawings are included to provide a further understanding of the present disclosure, and are incorporated in and constitute a part of this specification.

DETAILED DESCRIPTION OF THE EMBODIMENTS

Figure 1:
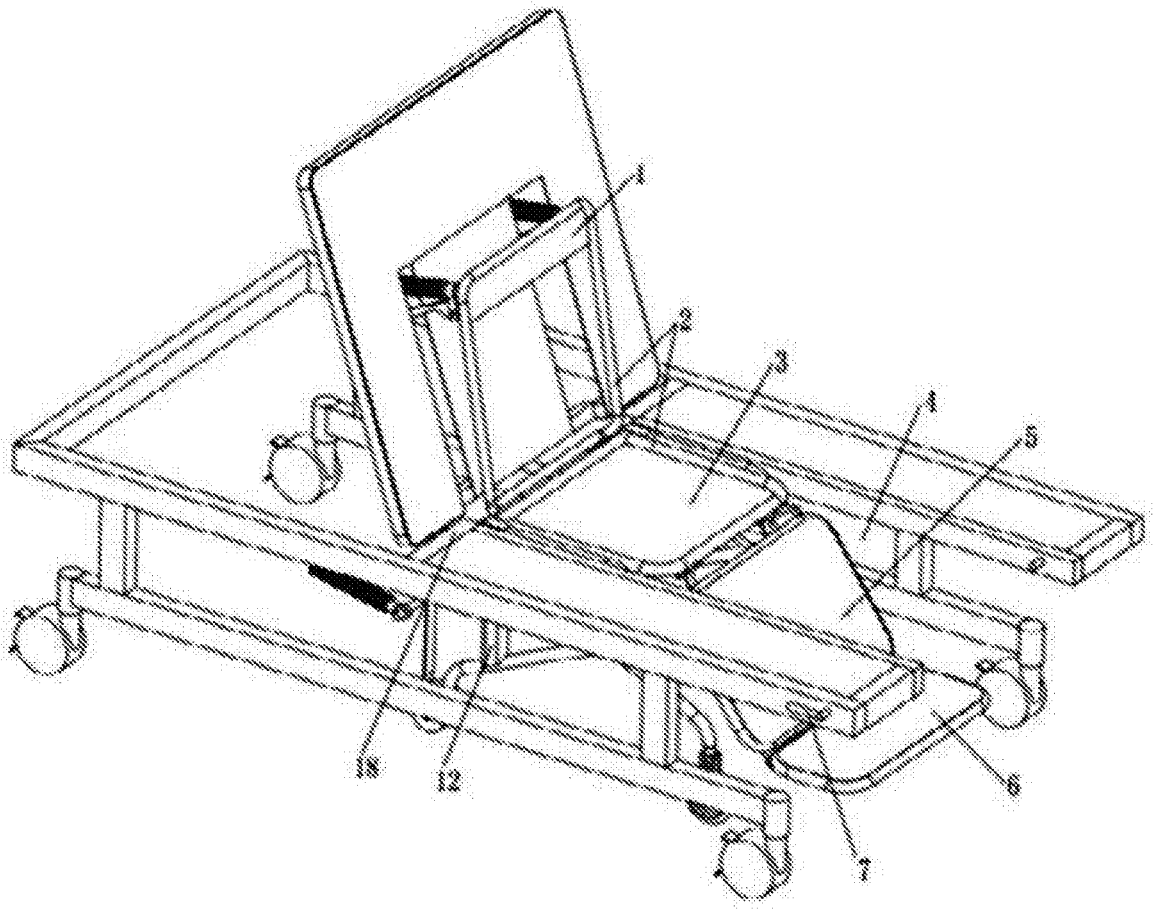
FIG. 1 is a structural schematic diagram of a care bed in accordance with at least one embodiment of the present disclosure.

The present disclosure will be further described in detail below in conjunction with the drawings and embodiments. It is to be understood that the specific embodiments described herein are intended to be illustrative only and not limiting. It is also to be noted that, for the convenience of description, only parts related to the present disclosure are shown in the drawings.

It should be noted that the embodiments in the present disclosure and the features in the embodiments may be combined with each other without conflict. The present disclosure will be described in detail below with reference to the drawings and embodiments.

In at least one embodiment of the present disclosure, the present disclosure provides a care bed, as shown in FIG. 1, comprising a bed body which is provided with a groove 4; and a wheelchair which is disposed in the groove 4. The wheelchair includes: a wheelchair support 2, sequentially provided with a wheelchair back plate 1, a seat plate 3, a leg plate 5 and a foot plate 6, the seat plate 3 is fixed to the wheelchair support 2.

Figure 2:
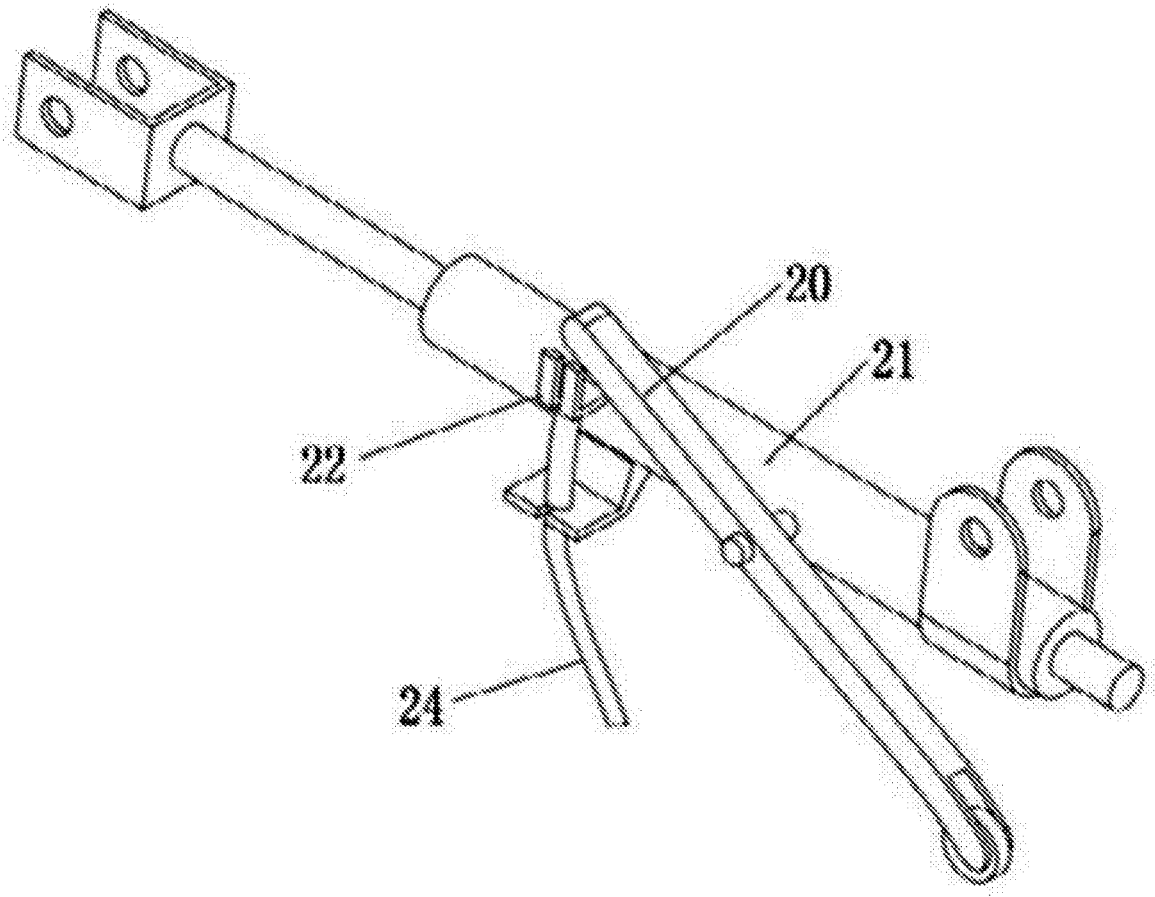
FIG. 2 is a structural schematic diagram of a double-traction lifting regulator provided with a shift lever in accordance with at least one embodiment of the present disclosure.
Figure 3:
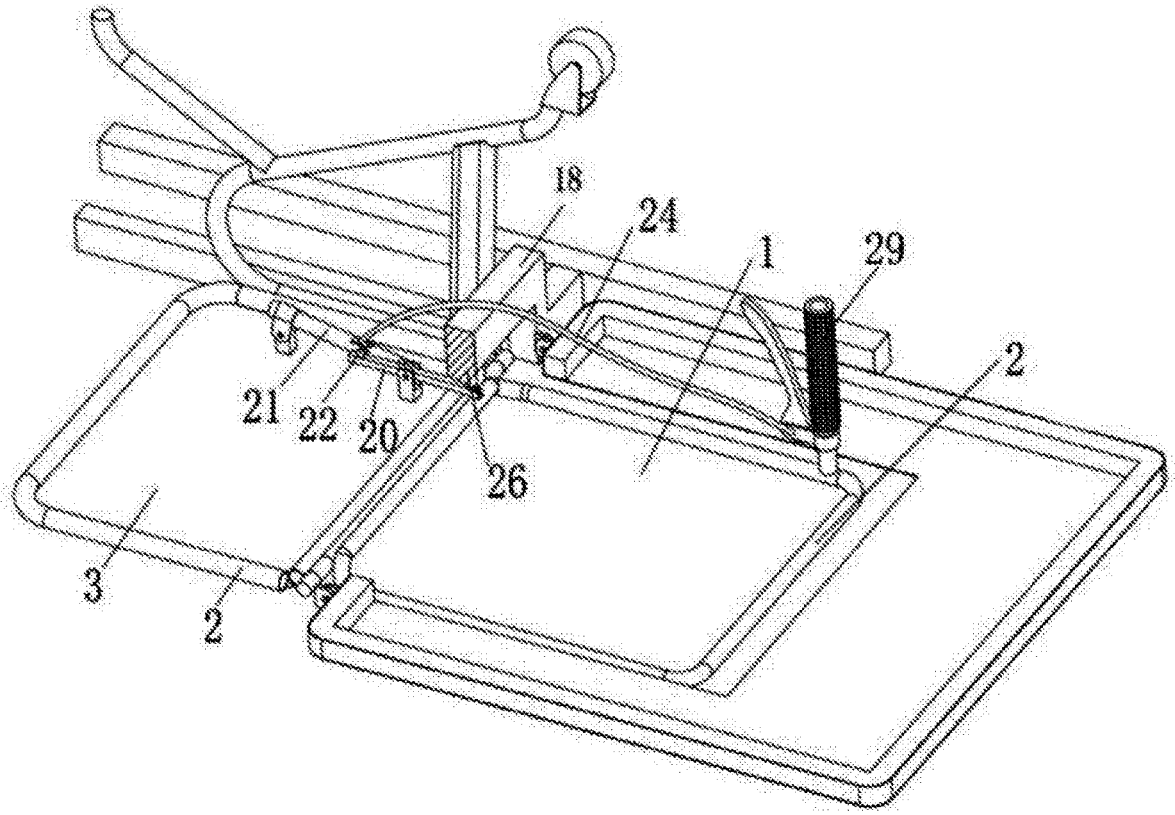
FIG. 3 is a schematic diagram of a combination of the bed and the wheelchair in accordance with at least one embodiment of the present disclosure, wherein the shift lever is matched with the step disposed on a bed body support.

As shown in FIGS. 2 and 3, the care bed provided by the present disclosure further includes: a double-traction lifting regulator 21, which is disposed below the connection position between the wheelchair back plate 1 and the seat plate 3; and a locking member 22, which is disposed on the double-traction lifting regulator 21, and used for locking double-traction lifting regulator 21; a first traction member, which is connected to the locking member 22, and used for controlling the rise and fall of the wheelchair back plate 1 when the wheelchair is separated from the bed body, which may include a first brake wire 24 and a hand control traction handlebar 29, the hand control traction handlebar 29 may be a brake handlebar; and a second traction member, which is connected to the locking member 22, when the wheelchair is combined with the bed body, the second traction member controls the locking member 22 to be loosened, so that the wheelchair back plate 1 and the back plate of the bed body rise or fall at the same time; and when the wheelchair is separated from the bed body, the second traction member controls the locking member 22 to be locked, so that the rise and the fall of the wheelchair back plate 1 is controlled by the first traction member.

Specifically, when the wheelchair and the bed are combined, the second traction member controls the locking member 22 to be loosened, so that the double-traction lifting regulator 21 is in a released state, and the wheelchair back plate 1 can be lifted and dropped along with the bed back plate together in an angle for lifting and dropping back according to normal requirements.

When there is need to separate the wheelchair from the bed body, the wheelchair back plate 1 and the bed back plate are lifted at a larger angle than when lifting and dropping back normally, and the second traction member controls the locking member 22 to be locked, so that the double-traction lifting regulator 21 is locked, the wheelchair back plate 1 is fixed in the nearly upright state, and at the same time the bed back plate is controlled to withdraw to the maximum angle for lifting and dropping back normally, so that the wheelchair can be pushed out from the groove 4 of the bed body. After the wheelchair is pushed out, the first brake wire 24 is pulled by the hand control traction handlebar 29 to control the double-traction lifting regulator 21 to be locked or loosened, which realizes free lifting and dropping of the wheelchair back plate 1.

According to another embodiment of the present disclosure, as shown in FIGS. 2 and 3, the second traction member includes a shift lever 20 that can be supported by a bracket provided under the seat plate 3. The front end of the shift lever is in contact with the locking member 22, and the rear end of the shift lever is matched with a step 26 provided on the bed body support 18. When the wheelchair is combined with the bed body, the rear end of the shift lever 20 can rest on the step 26 and the locking member 22 can be released; when the wheelchair is separated from the bed body, the rear end of the shift lever can be dropped from the step 26, and the locking member 22 is locked.

According to another embodiment of the present disclosure, the rear end of the shift lever 20 may be a unidirectional curved tube that can be elastically reset.

According to another embodiment of the present disclosure, the step 26 may be a slidable step or a fixed step.

According to another embodiment of the present disclosure, the second traction member further includes a soft cable, which is connected to the slidable step and able to pull the slidable step to slide.

Figure 4:
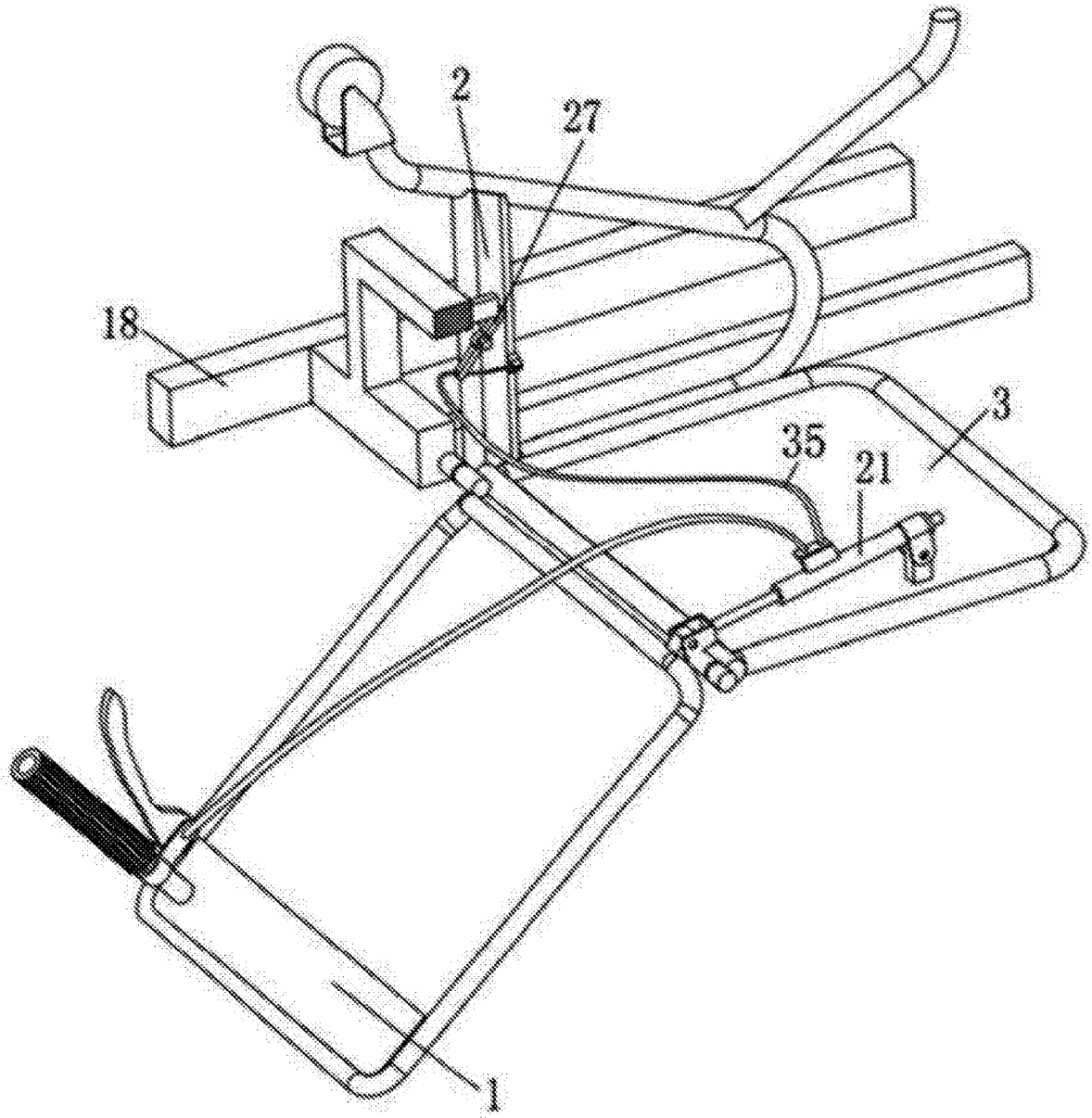
FIG. 4 is a schematic diagram of connections of a lever of the second traction member in accordance with at least one embodiment of the present disclosure.

According to another embodiment of the present disclosure, as shown in FIG. 4, the second traction member may include a second brake wire 35; and a lever 27 connected to the second brake wire 35, and a fulcrum of the lever is provided at the rear portion of the wheelchair support 2, e.g. on the rear leg of the wheelchair. When the wheelchair is combined with the bed, one end of the lever 27 is subjected to the thrust applied by the bed body support 18 and rotates, so that the second traction member is tensioned, and at the same time the second traction member controls the locking member 22 to release.

Figure 5:
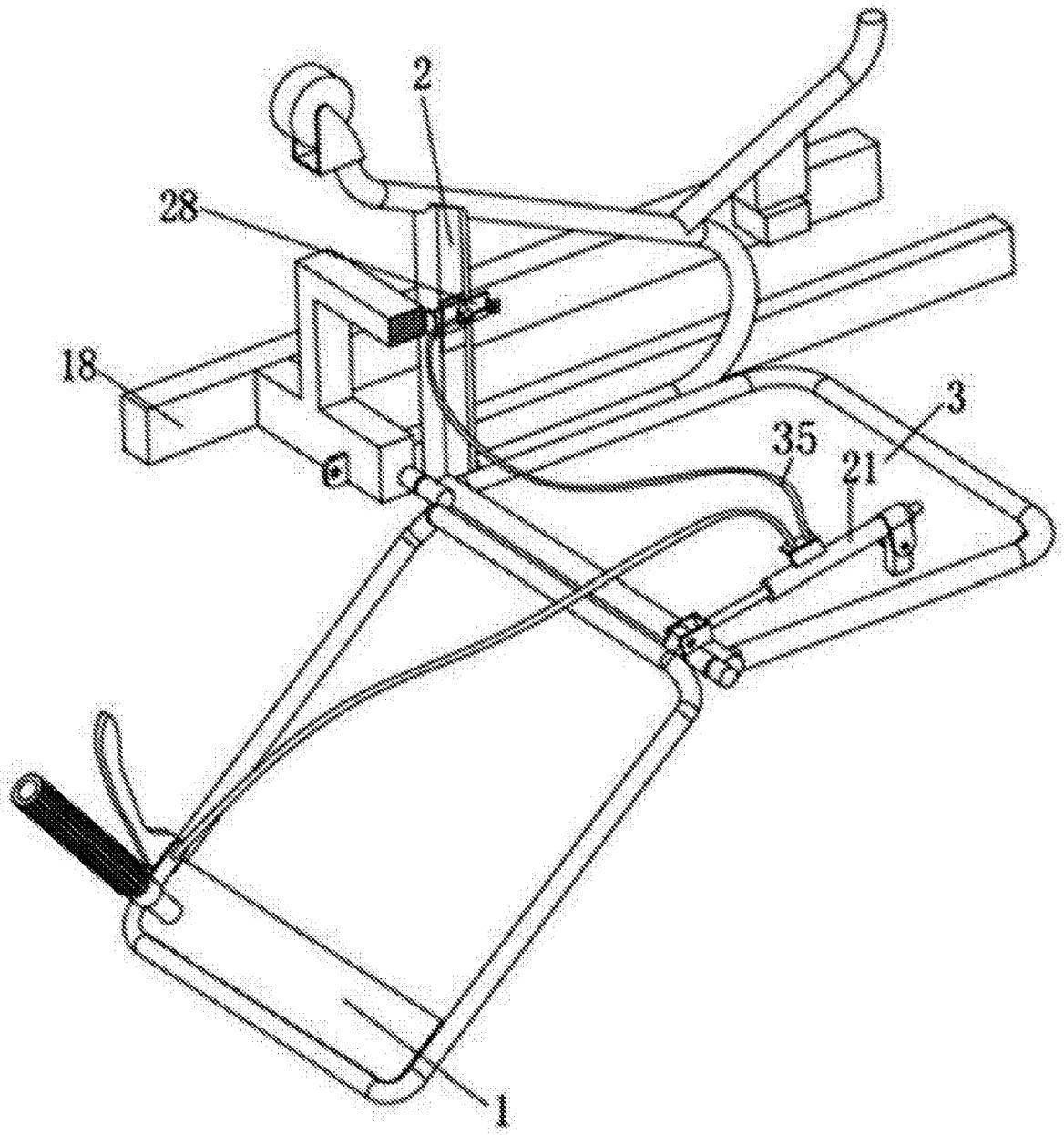
FIG. 5 is a schematic diagram of connections of a slider member of the second traction member in accordance with at least one embodiment of the present disclosure.

According to another embodiment of the present disclosure, as shown in FIG. 5, the second traction member may also include a second brake wire 35; and a slider member connected to the second brake wire 35 and located in a chute fixed at the rear portion of the wheelchair support 2, e.g. in the chute of the rear leg of the wheelchair. When the wheelchair is combined with the bed, the slider member 28 is subjected to the thrust applied by the bed body support 18 and slides, so that the second traction member is tensioned, and the second traction member controls the locking member 22 to release.

Figure 6:
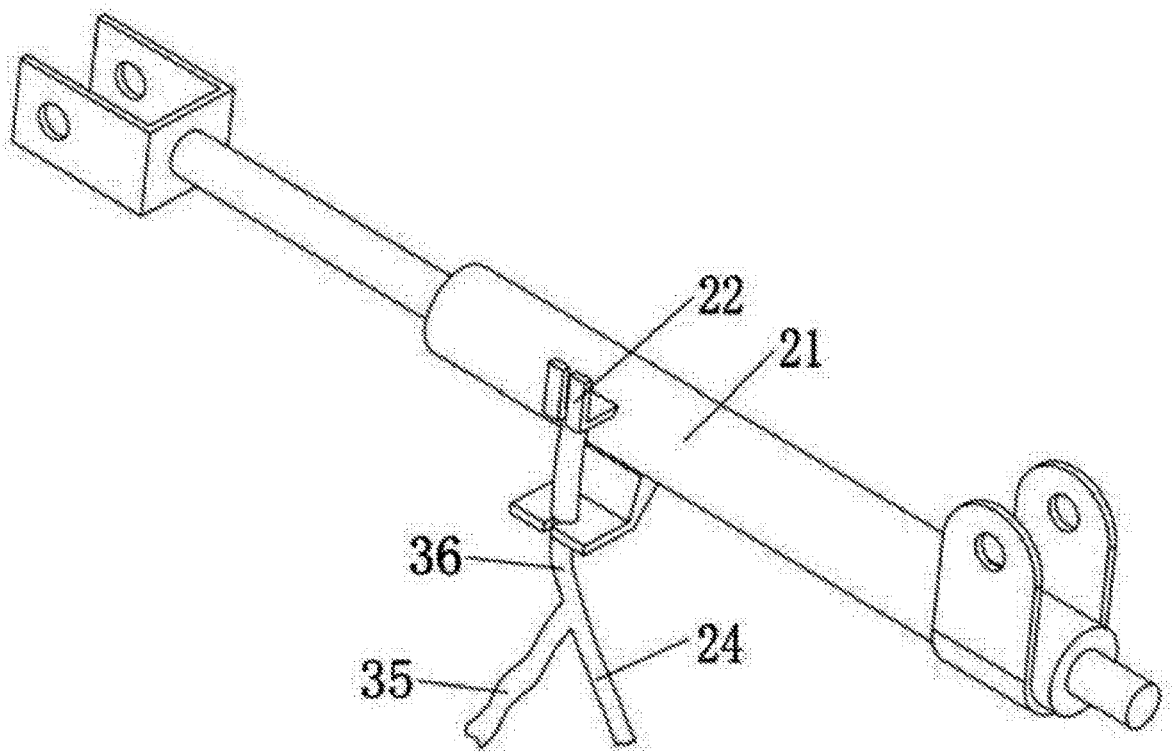
FIG. 6 is a structural schematic diagram of a double-control brake wire of a double-traction lifting regulator in accordance with at least one embodiment of the present disclosure.

According to another embodiment of the present disclosure, as shown in FIG. 6, the first brake wire 24 and the second brake wire 35 may be combined into one dual-control brake wire 36.

According to another embodiment of the present disclosure, the care bed may include only the second traction member, when the wheelchair and the bed are separated, the second traction member controls the locking member 22 to be locked, and the double-traction lifting regulator is in a locked state, the wheelchair back plate 1 is fixed.

The care bed provided by the present disclosure uses the above-mentioned double-traction lifting regulator 21, and when the wheelchair is combined with the bed body, the wheelchair back plate 1 and the bed back plate can be raised and fell simultaneously with convenient operations, and when the wheelchair and the bed are separated, the back plate 1 can be raised, fell or fixed freely by using separate control mechanism. Therefore, it is very convenient to separate and combine the wheelchair and the bed of sickbed or care bed, the true effect is that the barrier-free transfer of the disabled patient between the bed and the wheelchair can be realized, which gives great help to taking care of disabled elderly people in China's aging society.

Figure 7:
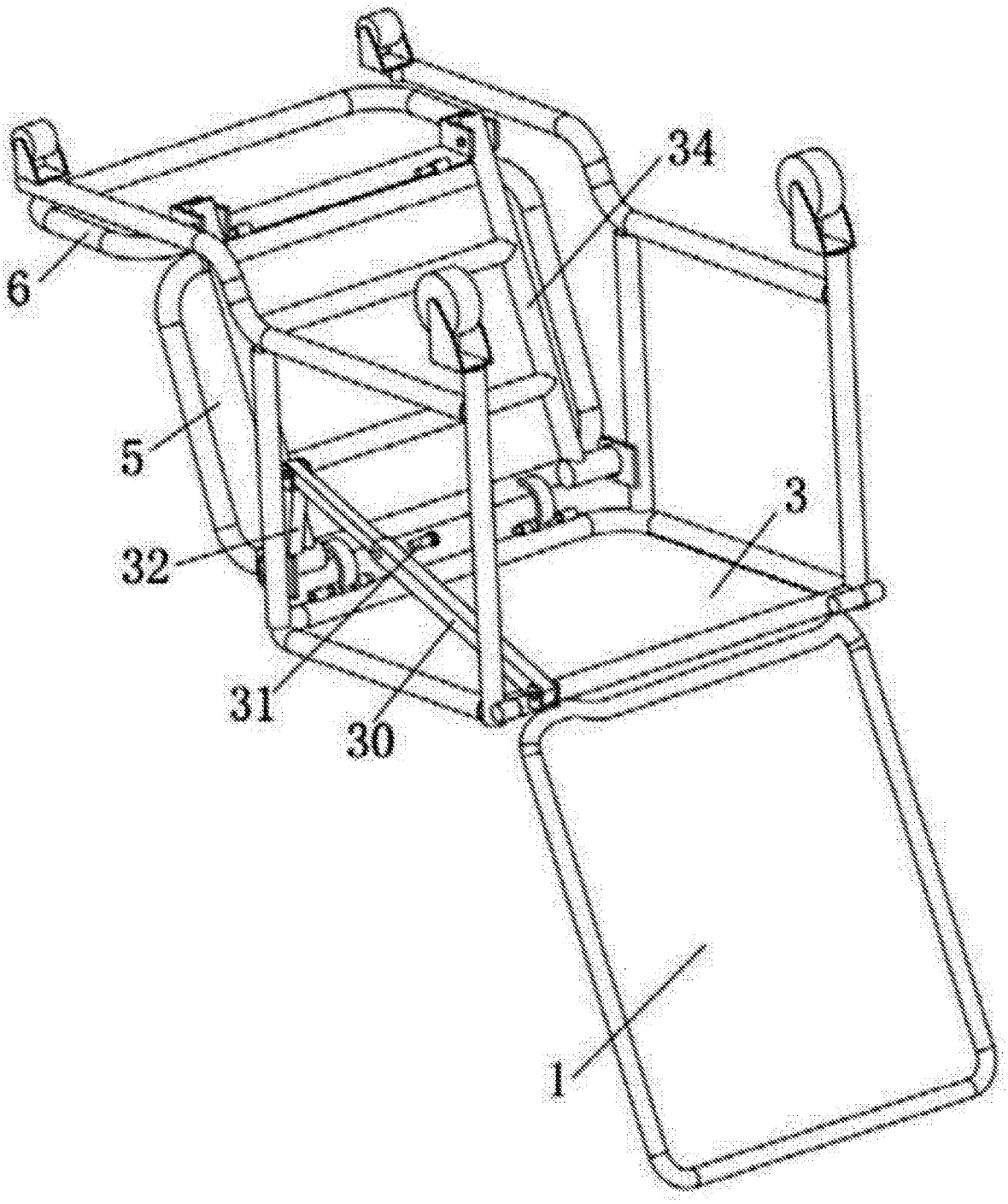
FIG. 7 is a schematic diagram of connections of a sliding connecting rod in accordance with at least one embodiment of the present disclosure.

According to another embodiment of the present disclosure, as shown in FIG. 7, the care bed provided by the present disclosure further includes: a sliding connecting rod 30 connected to the wheelchair back plate 1 and the wheelchair leg lifting and dropping support 34 respectively, the wheelchair leg lifting and dropping support 34 is used to control the lifting and dropping of the leg plate 5 and the foot plate 6, more specifically, the sliding connecting rod 30 can be connected to the auxiliary arm 32 of the wheelchair leg lifting and dropping 34; a locking and releasing bolt 31 provided on the sliding connecting rod 30, which is used to lock the sliding connecting rod 30 when the wheelchair is separated from the bed body, so that the wheelchair back plate 1 can be moved with the leg plate 5 and the foot plate 6 jointly.

Figure 8:
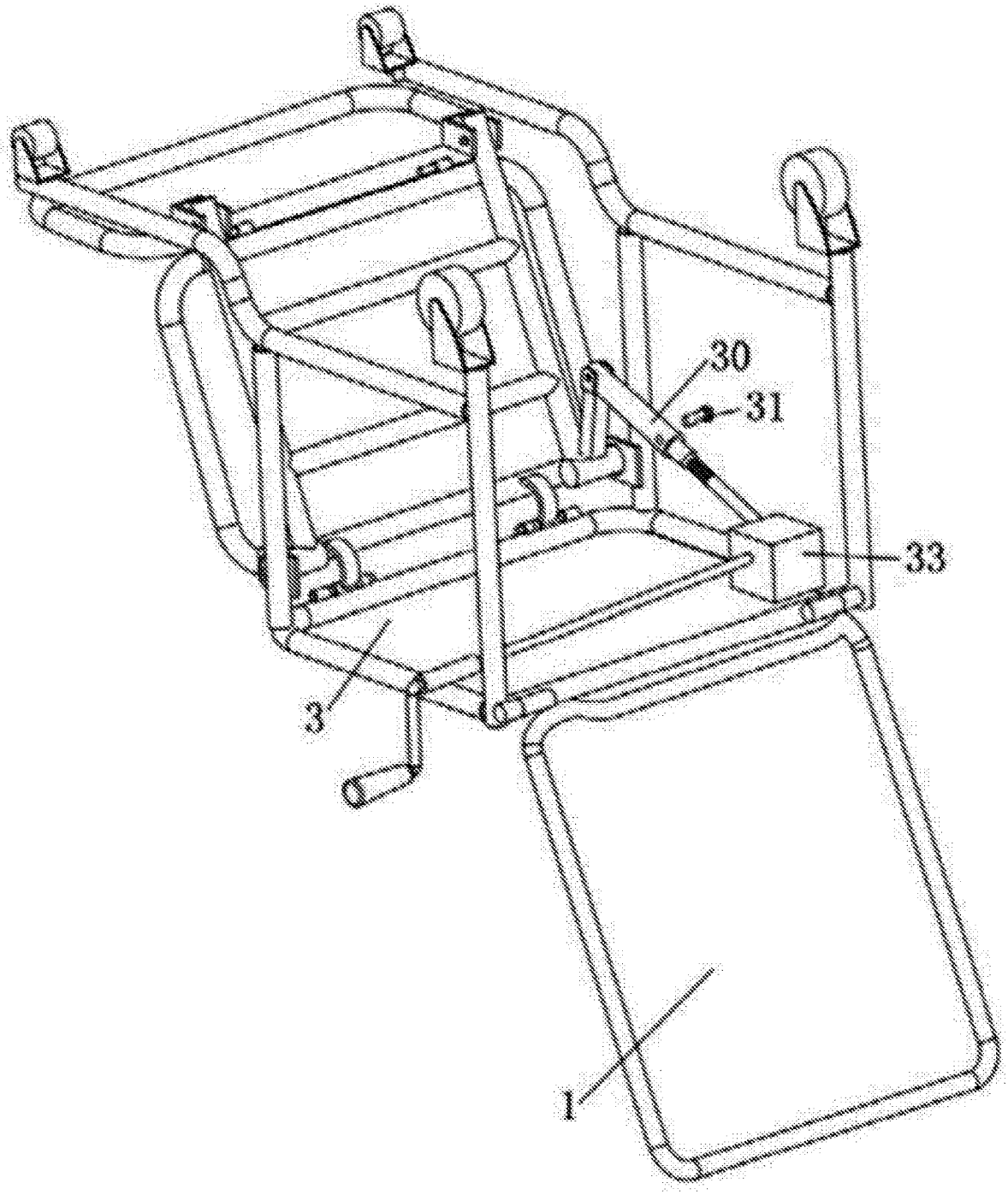
FIG. 8 is a schematic diagram of connections of a wheelchair leg lifting and dropping driving mechanism in accordance with at least one embodiment of the present disclosure.

According to another embodiment of the present disclosure, as shown in FIG. 8, the care bed further includes a wheelchair leg lifting and dropping driving mechanism 33 disposed under the seat plate 3, which is connected to the sliding connecting rod 30, and the wheelchair leg lifting and dropping driving mechanism 33 controls sliding connecting rod 30 so that the wheelchair can be transformed to a wheelchair, a recliner or a flat bed mutually.

Figure 9:
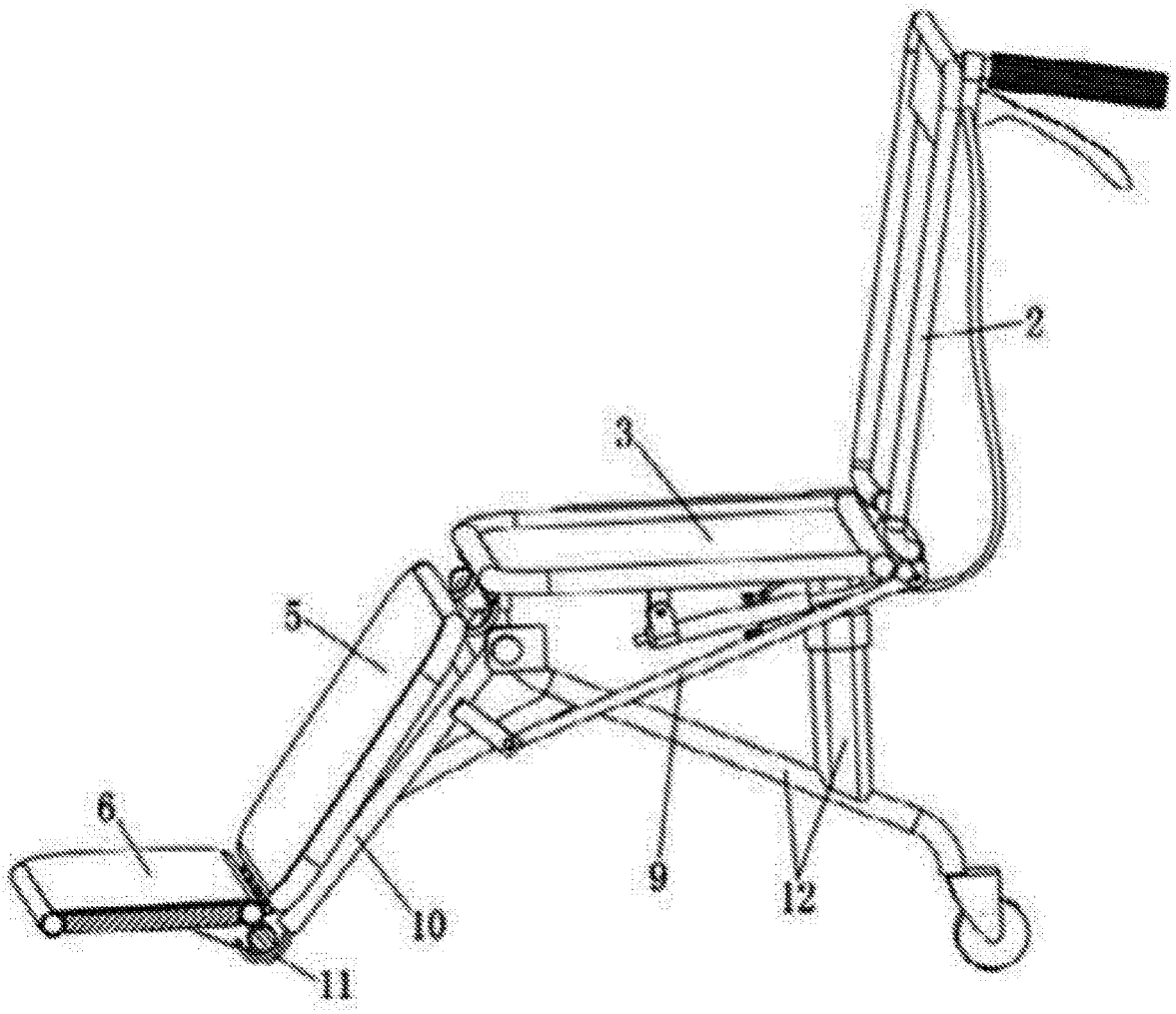
FIG. 9 is a structural schematic diagram of a wheelchair in accordance with at least one embodiment of the present disclosure.

According to another embodiment of the present disclosure, as shown in FIGS. 1 and 9, the care bed further includes: a bracket 10 provided below the front portion of the seat plate 3 and hinged to the wheelchair support 2; a bracket hook 11 disposed at the front portion of the bracket 10 extends to the lower side of the foot plate 11, controls the rotation angle of the foot plate 6; a linkage stick 9 is connected to the rear portion of the bracket 10; a bolt 7 is disposed at the end of the bed.

Figure 10:
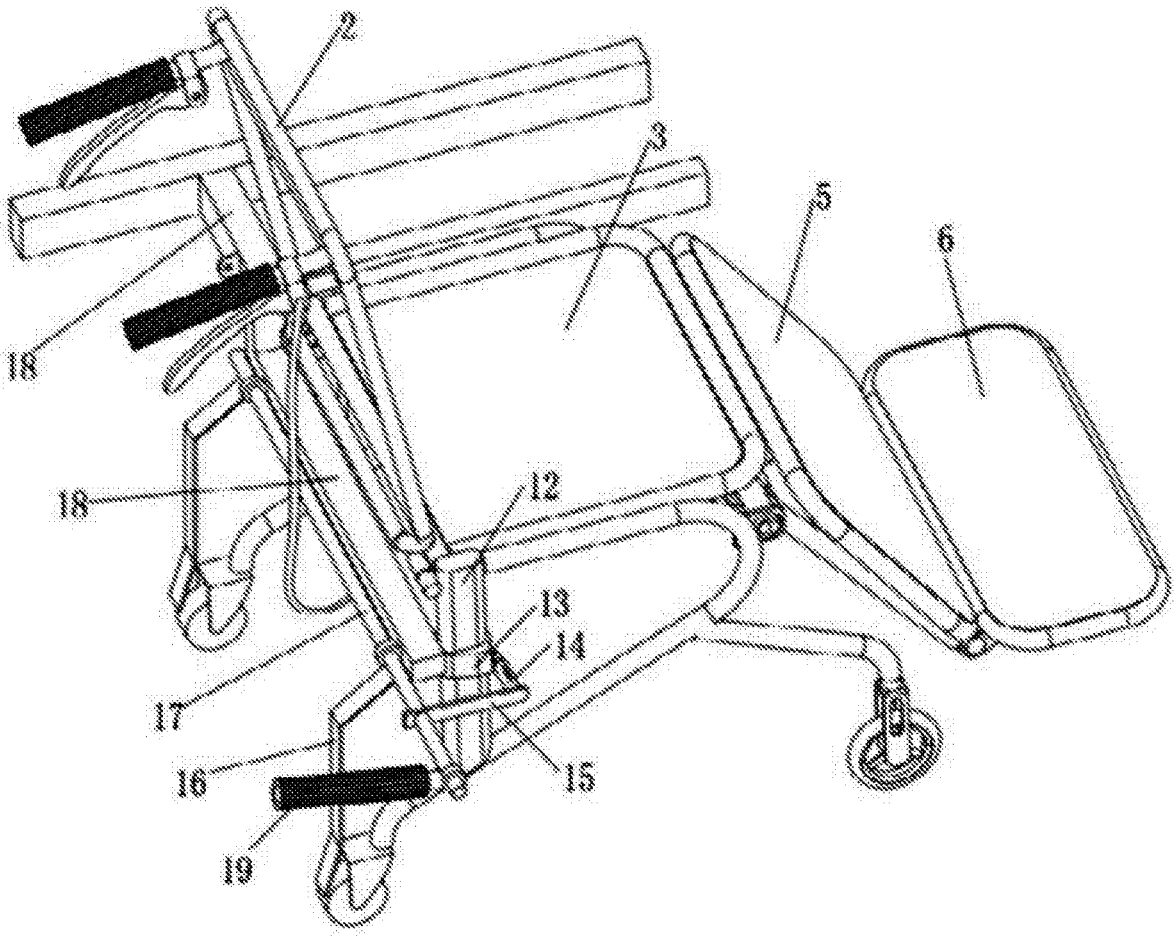
FIG. 10 is a structural schematic diagram of a quick locking and releasing mechanism in accordance with at least one embodiment of the present disclosure.

As shown in FIG. 10, the care bed provided by the present disclosure further includes: a diagonal block 13, which is disposed on the outside the rear leg 12 of the wheelchair, and the width of the diagonal block gradually increases along the length direction of the bed body; a horizontal shaft 17, which is disposed on the bed body support 18, supported by the bed body support 18, and the direction of the horizontal shaft 17 is the same as the width direction of the bed body support 18; an elastic contact fixing buckle 14, which is parallel to the horizontal shaft 17, and the horizontal height of the elastic contact fixing buckle 14 is slightly lower than the horizontal shaft 17; a rigid connecting rod 15 is connected to the rear end of the elastic contact fixing buckle 14 and the horizontal shaft 17 respectively; a shift handle 19 is disposed on the horizontal shaft 17; and toggle levers 16 are disposed on the horizontal shaft 17 and used to push out the wheelchair. The length of the elastic contact fixing buckle 14 can be changed depended on the situation. When the elastic contact fixing buckle 14 is in an extended state, its longest length is set so that it can contact the diagonal block 13, but not touch the rear leg 12 of the wheelchair; when it is in a compressed state, its shortest length is set so that it can barely contact the widest part of the diagonal block 13 or cannot contact the widest part of the diagonal block 13. When the wheelchair is combined with the bed body, the elastic contact fixing buckle 14 is engaged with the diagonal block 13, so that the wheelchair and the bed body can be merged. When the wheelchair is separated from the bed body, the shift handle 19 is rotated, which causes the horizontal axis 17, the rigid connecting rod 15, and the elastic contact fixing buckle 14 to rotate at the same time, after the elastic contact fixing buckle 14 rotates, it is disengaged from the diagonal block 13. At the same time, the toggle levers 16 are rotated to push the wheelchair outward from the groove 4 of the bed body, so as to separate the wheelchair from the bed body. When the wheelchair is combined with the bed body, the wheelchair is pushed into the groove 4, the elastic contact fixing buckle 14 is in contact with the diagonal block 13 and compressed, as the wheelchair is continuously pushed into the groove 4, the elastic contact fixing buckle 14 is continuously compressed along the diagonal block 13 until the wheelchair is completely pushed into the groove 4 to reach the position where the wheelchair can be connected to the bed body, and the elastic contact fixing buckle 14 resumes the extended state, and is engaged with the diagonal block 13, thus the wheelchair is combined with the bed body.

With the care bed provided by the present disclosure, a bedridden patient can be pushed out from a wheelchair or returned to the bed by simple operations without physical contact between the nurses and the people who being taken care of, which greatly reduces the labor intensity of the nurses and increases the comfort of the people who being taken care of.

It should be understood by those skilled in the art that the above embodiments are merely for the purpose of clearly illustrating the disclosure, and are not intended to limit the scope of the disclosure. For those skilled in the art, on the basis of the above disclosure, other changes or modifications may be made, and these changes or modifications are still within the scope of the present disclosure.

What is claimed is:

1. A care bed, comprising:

a bed body, wherein the bed body is provided with a groove;

a wheelchair, wherein the wheelchair is disposed in the groove, and the wheelchair comprises a wheelchair support, a double-traction lifting regulator, a locking member, a first traction member and a second traction member;

wherein, the wheelchair support is sequentially provided with a wheelchair back plate, a seat plate, a leg plate and a foot plate, and the seat plate is fixed to the wheelchair support;

wherein, the double-traction lifting regulator is disposed below a connection position between the wheelchair back plate and the seat plate;

wherein, the locking member is disposed on the double-traction lifting regulator and is configured to lock the double-traction lifting regulator;

wherein, the first traction member is connected to the locking member and is configured to control a rise and a fall of the wheelchair back plate when the wheelchair is separated from the bed body; and wherein, the second traction member is connected to the locking member, when the wheelchair is combined with the bed body, the second traction member controls the locking member to be loosened, so that the wheelchair back plate and a back plate of the bed body rise or fall at a same time; and when the wheelchair is separated from the bed body, the second traction member controls the locking member to be locked, so that the rise and the fall of the wheelchair back plate is controlled by the first traction member.

2. The care bed according to claim 1, further comprising:

a sliding connecting rod, wherein the sliding connecting rod is connected to the wheelchair back plate and a wheelchair leg lifting and dropping support respectively, and the wheelchair leg lifting and dropping support is configured to control a lifting and a dropping of the leg plate and the foot plate; and a locking and releasing bolt, wherein the locking and releasing bolt is provided on the sliding connecting rod and is configured to lock the sliding connecting rod when the wheelchair is separated from the bed body, so that the wheelchair back plate is moved with the leg plate and the foot plate jointly.

3. The care bed according to claim 2, further comprising a wheelchair leg lifting and dropping driving mechanism, wherein the wheelchair leg lifting and dropping driving mechanism is disposed under the seat plate and is connected to the sliding connecting rod, and the wheelchair leg lifting and dropping driving mechanism controls the sliding connecting rod so that the wheelchair is transformed to a wheelchair, a recliner or a flat bed mutually.

4. The care bed according to claim 1, wherein the second traction member comprises:

a shift lever, wherein a front end of the shift lever is in a contact with the locking member, and a rear end of the shift lever is matched with a step provided on a bed body support, when the wheelchair is combined with the bed body, the rear end of the shift lever rests on the step and the locking member is released; when the wheelchair is separated from the bed body, the rear end of the shift lever is dropped from the step, and the locking member is locked.

5. The care bed according to claim 4, wherein the rear end of the shift lever is a unidirectional curved tube and the unidirectional curved tube is elastically reset.

6. The care bed according to claim 4, wherein the step is a slidable step or a fixed step.

7. The care bed according to claim 6, wherein the second traction member further comprises a soft cable, and the soft cable is connected to the slidable step and is configured to pull the slidable step to slide.

8. The care bed according to claim 1, wherein the second traction member comprises:

a second brake wire; and a lever, wherein the lever is connected to the second brake wire, and a fulcrum of the lever is provided at a rear portion of the wheelchair support, and when the wheelchair is combined with the bed body, an end of the lever is subjected to a thrust applied by a bed body support and rotates, so that the second traction member is tensioned, and the second traction member controls the locking member to release.

9. The care bed according to claim 1, wherein the second traction member comprises:

a second brake wire; and a slider member, wherein the slider member is connected to the second brake wire, the slider member is located in a chute fixed at a rear portion of the wheelchair support, and when the wheelchair is combined with the bed body, the slider member is subjected to a thrust applied by a bed body support and slides, so that the second traction member is tensioned, and the second traction member controls the locking member to release.

10. The care bed according to claim 1, further comprising:

a bracket, wherein the bracket is disposed below a front portion of the seat plate and is hinged to the wheelchair support;

a bracket hook, wherein the bracket hook is disposed at a front portion of the bracket, and extends to a lower side of the foot plate, and the bracket hook controls a rotation angle of the foot plate;

a linkage stick, wherein the linkage stick is connected to a rear portion of the bracket;

a bolt, wherein the bolt is disposed at an end of the bed;

a diagonal block, wherein the diagonal block is disposed on an outside of a rear leg of the wheelchair, and a width of the diagonal block gradually increases along a length direction of the bed body;

a horizontal shaft, wherein the horizontal shaft is disposed on a bed body support and is supported by the bed body support, and a direction of the horizontal shaft is the same as a width direction of the bed body support;

an elastic contact fixing buckle, wherein the elastic contact fixing buckle is parallel to the horizontal shaft;

a rigid connecting rod, wherein the rigid connecting rod is connected to a rear end of the elastic contact fixing buckle and the horizontal shaft, respectively;

a shift handle, wherein the shift handle is disposed on the horizontal shaft;

a plurality of toggle levers, wherein the plurality of toggle levers are disposed on the horizontal shaft;

wherein, when the wheelchair is combined with the bed body, the elastic contact fixing buckle is engaged with the diagonal block, so that the wheelchair and the bed body are merged; when the wheelchair is separated from the bed body, the shift handle is rotated, so that the elastic contact fixing buckle is rotated and separated from the diagonal block, meanwhile the plurality of toggle levers are rotated to push the wheelchair to move toward the end of the bed.

* * * * *